US006280342B1

(12) United States Patent
Tod

(10) Patent No.: US 6,280,342 B1
(45) Date of Patent: Aug. 28, 2001

(54) SLIDE APPARATUS AND METHOD

(76) Inventor: Robert Powell Tod, 551 Blue Creek Dr., Dripping Springs, TX (US) 78620

( * ) Notice: Subject to any disclaimer, the term of this patent is extended or adjusted under 35 U.S.C. 154(b) by 0 days.

(21) Appl. No.: 09/616,215

(22) Filed: Jul. 14, 2000

(51) Int. Cl.[7] ..... A63G 21/00
(52) U.S. Cl. ..... 472/116; 472/117
(58) Field of Search ..... 472/116, 117, 472/128; 104/69, 70, 53; 182/48, 49

(56) References Cited

U.S. PATENT DOCUMENTS

| | | | | |
|---|---|---|---|---|
| 0,284,994 | | 9/1883 | Avery . | |
| 0,459,319 | | 9/1891 | Thoresen . | |
| 0,920,296 | | 5/1909 | Erwin et al. . | |
| 0,952,315 | | 3/1910 | Erwin et al. . | |
| 1,511,139 | * | 10/1924 | Roziger | 472/116 |
| 1,520,217 | | 12/1924 | Auperl . | |
| 2,705,144 | | 3/1955 | Ridgway . | |
| 3,994,366 | | 11/1976 | Okuma et al. . | |
| 5,735,748 | * | 4/1998 | Meyers et al. | 472/117 |
| 6,146,282 | * | 11/2000 | McCready et al. | 472/117 |

FOREIGN PATENT DOCUMENTS 83850213 8/1983 (EP) .

* cited by examiner

*Primary Examiner*—Kien T. Nguyen
(74) *Attorney, Agent, or Firm*—J. Nevin Shaffer, Jr.; Shaffer & Culbertson, LLP

(57) ABSTRACT

A slide (10) with a pair of suspension cables (12) and flexible material (14) connected to the cables (12). At least one lift (16) and one fall (18) is provided in the slide (10) from beginning to end. In the preferred embodiments, slide (10) includes lifts (16), falls (18), tunnels, loops and curves. Additionally, in a preferred embodiment, free hanging spreader bars (70) are provided to hold suspension cables (12) and flexible material (14) in their original spaced apart hanging position.

20 Claims, 4 Drawing Sheets

SLIDE APPARATUS AND METHOD

BACKGROUND OF THE INVENTION

This invention relates to an improved slide apparatus and method. In particular, this invention relates to a cabled tarp water slide.

A wide variety of slides, both with and without water, have been known in the art for some time. Much of the art is directed to slides for use in escaping buildings in the event of fire. Avery, U.S. Pat. No. 284,994; Thoresen, U.S. Pat. No. 459,319; Erwin, et al., U.S. Pat. No. 920,296; and Erwin, et al., U.S. Pat. No. 952,315, are exemplary of the state of the art for fire slides. More recent escape devices are exemplified by Okuma, et al., U.S. Pat. No. 3,994,366.

Still further, the art includes slides used for amusement. The Auperl Patent, U.S. Pat. No. 1,520,217 discloses an amusement slide designed to pull a rowboat like device up an incline and then allow the rowboat to slide down a cable guide into a lake, river, or other body of water. The Ridgway Patent, U.S. Pat. No. 2,705,144, discloses an amusement slide wherein a person enters a shelter and stands on a trap door. The trap door is sprung and the user drops through the hole and onto an elongated sheet of steel. The steel is surrounded by canvas sides to prevent a person from sliding off the steel sheet during the journey along the length of the landing element. The European patent to Franzetti, EP0110843 discloses a water slide comprised of a continuous reinforced plastic web of soft polyvinyl chloride connected to tubular PVC posts which are subsequently connected to a number of support posts. The supports posts and the supports for the polyvinyl web are rigid and multi-pieced. In short, the prior art discloses slides which are expensive and time consuming to create and maintain.

A further drawback to the slides known in the art is that, in addition to being expensive to construct and maintain, they are not easily adaptable to use in primitive camp sites, in forests, and in natural settings without the disruption of the setting by the creation and installation of the supports and so forth. Still further, even the prior art slides which are somewhat easier to construct lack the features of the true amusement park ride in the nature of lifts, (i.e. jumps), and falls, (i.e. drops), throughout the length of the slide.

Thus, there is a need in the art for providing a slide which is easy to construct, inexpensive to maintain, and which includes at least one lift and one fall over the course of its length. It, therefore, is an object of this invention to provide an improved slide which is easy and inexpensive to construct and maintain and which includes amusement park like features, such as lifts and falls.

SHORT STATEMENT OF THE INVENTION

Accordingly, the slide of the present invention includes at least a pair of suspension cables connected at one high end to a slide support and at the opposite low end to another support. A flexible material is connected to the suspension cables and the flexible material includes at least one lift and one fall over its length. In a preferred embodiment, the slide includes a fall at the low end of the slide and at least one intermediate fall. In another preferred embodiment, intermediate falls are created by the combination of a flexible material of one width, connected to the suspension cables, which slightly overlaps a subsequent, separate section of flexible material of a wider width. The wider width of the second section of flexible material causes the second section of flexible material to be separated from the first section by some distance, thereby creating a fall at a point along the intermediate total length of the slide.

A further embodiment of the present invention includes lifts created by attaching wedges of material between two connecting sections of flexible material with the narrow end of the wedge facing the high end of the slide. Still another preferred embodiment of the present invention includes the creation of a lift by means of utilizing at least one direction change cable connected to the suspension cables at a lift point on one end and to an immovable supporting structure at the other end. As a result, the flexible material is restrained against deflection at the lift point by the direction change cable, thereby creating a lift. Still other preferred embodiments include curves, loops, and tunnels in the slide.

BRIEF DESCRIPTION OF THE DRAWINGS

Other objects, features and advantages of the present invention will become more fully apparent from the following detailed description of the preferred embodiments, the appended claims, and the accompanying drawings in which:

DETAILED DESCRIPTION OF THE PREFERRED EMBODIMENTS

Figure 1:
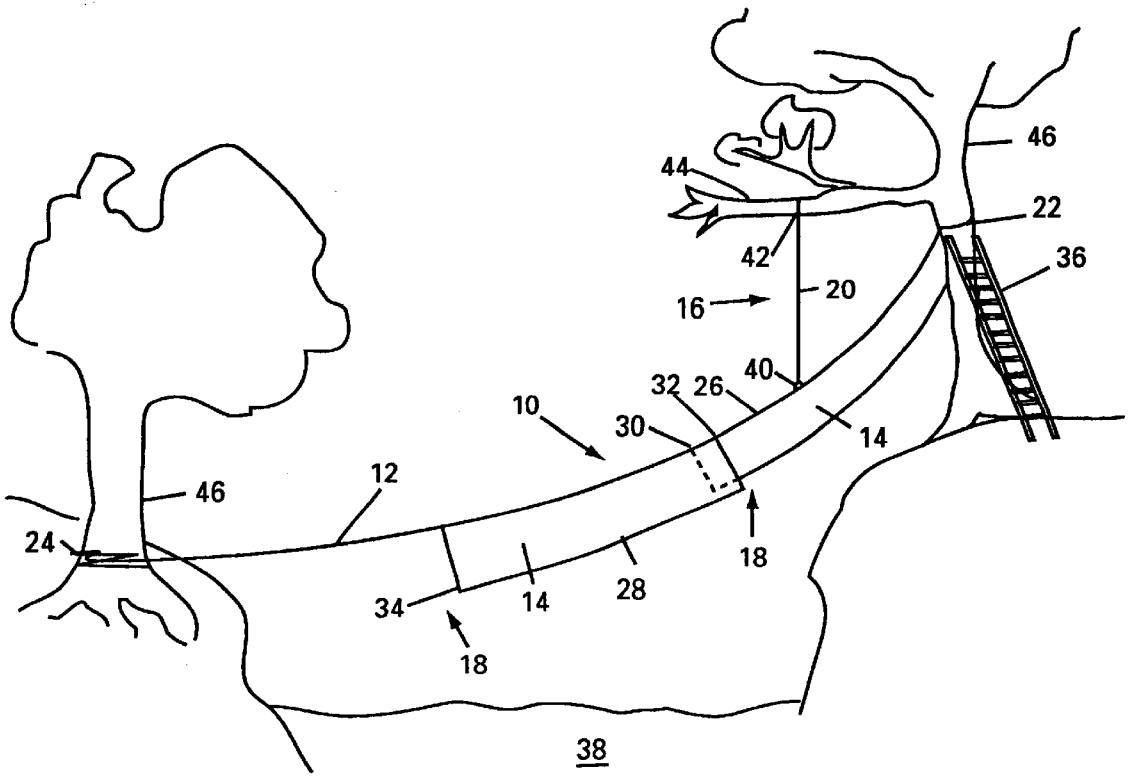
FIG. 1 is a side perspective view of a preferred embodiment of the slide of the present invention showing one lift and two falls.

The preferred embodiments of the present invention are illustrated by way of example in FIGS. 1–9. With specific reference to FIG. 1, a slide 10 includes suspension cables 12 (only one shown), flexible material 14, and at least one lift 16 and at least one fall 18. FIG. 1 also illustrates direction change cable 20 connected to suspension cables 12 and flexible material 14. Suspension cables 12 and slide 10 have a high end 22 and a low end 24.

FIG. 1 illustrates a preferred embodiment of the present invention whereby flexible material 14 is comprised of a first section 26 and a second section 28. In the embodiment illustrated, first section 26 is formed of flexible material of one particular width. First section 26 has an end 30. Second section 28 is comprised of flexible material 14 of another, greater, width. As a result, when second section 28 is connected to suspension cables 12, it hangs below first section 26. Second section 28 is connected to cables 14 at connection point 32, so that end 30 of first section 26 extends over and overlaps second section 28, thereby creating intermediate fall 18 at the end 30 of first section 26.

The second fall 18 of slide 10 as illustrated in FIG. 1 occurs at the end 34 of second section 28. As illustrated, in the preferred embodiment, a user climbs ladder 36 to access the high end 22 of slide 10. The user then slides down flexible material 14. If second section 28 is not attached, the user falls from first section 26 at end 30 of first section 26 into the water 38. With second section 28 attached, as illustrated in FIG. 1, a user experiences a fall at end 30 of first section 26 onto second section 28 and then another fall at end 34 of second section 28 into water 38.

Still referring to FIG. 1, lift 16 is disclosed. As illustrated, lift 16 includes direction change cable 20. Direction change cable 20 includes one end 40 connected to suspension cables 12 and another end 42 connected to a substantially non-moving support 44. Flexible material 14 and suspension cables 12 naturally respond by deflection when weight, as in a person sliding down flexible material 14, is applied sequentially along the length of flexible material 14 on the way to water 38. By way of direction change cable 20, however, suspension cables 12 are held immobile at connection end 40 so that the weight of a user sliding down flexible material 14 does not cause flexible material 14 to deflect. As a result, in effect, a lift 16 is created at the lift point created by end 40 of direction change cable 20.

Still referring to FIG. 1, in a preferred embodiment, slide 10 is constructed easily and simply in wilderness situations by using naturally available supports such as trees 46. FIG. 1 shows suspension cables 12 running from tree 46 on one side of water 38 to a tree 46 on the other side of water 38. Any obvious variations of this are acceptable. That is, trees 46 could be made of artificial and/or natural supports such as telephone poles, posts, rock formations or the like. Suspension cables 12 are not necessarily required to extend completely beyond water 38. That is, low end 24 of suspension cables 20 of slide 10, might actually terminate in water 38.

Figure 2:
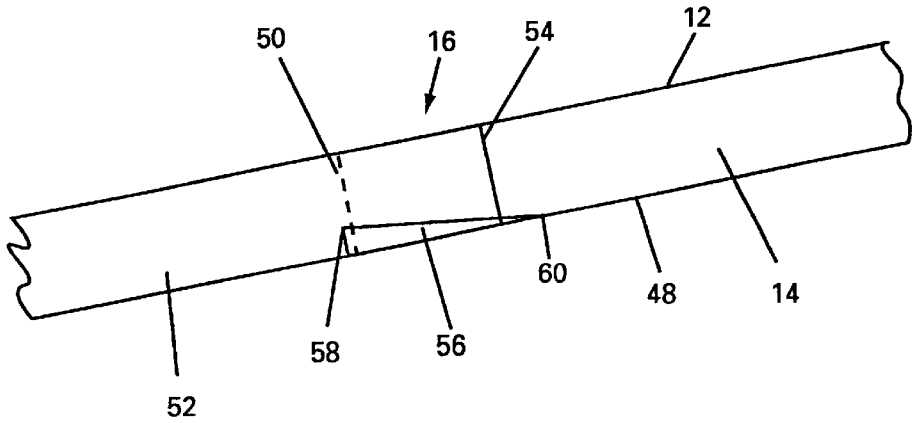
FIG. 2 is a side section view illustrating a preferred embodiment of a lift of the present invention.

Referring now to FIG. 2, a side view of a partial section of slide 10 is shown. FIG. 2 illustrates a lift 16 formed in the following manner. Flexible material 14 is connected in sections to make a long slide 10. At the point where section 48 ends at point 50, it is sewn to continuing section 52. While sewing flexible material 14 in place is a preferred embodiment, any means of joining sections of flexible material 14 together is appropriate, such as welding, gluing, and the like so long as the connection is more or less seamless. In a preferred embodiment for creating a lift 16, continuing section 52 is connected at point 54 to section 48 Section 48 overlaps continuing section 52 on the inside of continuing section 52 and continuing section 52 overlaps section 48 on the outside of section 48. In between section 48 and 52 is wedge 56. Wedge 56 has an elevated end 58 and a narrow end 60. Narrow end 60 is positioned toward high end 22 of slide 10 and elevated end 58 is positioned toward low end 24 of slide 10. Wedge 56 may be made of any appropriate material, such as foam rubber, or the like. As a result, by joining two sections of flexible material 14 as described, with wedge 56 positioned in between as described, a lift 16 is provided in slide 10. A user enters slide 10 on the high end 22 (not shown), slides down flexible material 14, on to narrow end 60, up wedge 56, and off of wedge 56 at elevated end 58, onto continuing section 52. This lift or jump 16 can be repeated as many times as desired. Applicant's slide 10 in a preferred embodiment, again, includes at least one lift 16 and at least one fall 18 throughout the course of the slide 10 from high end 22 to low end 24.

Figure 3:
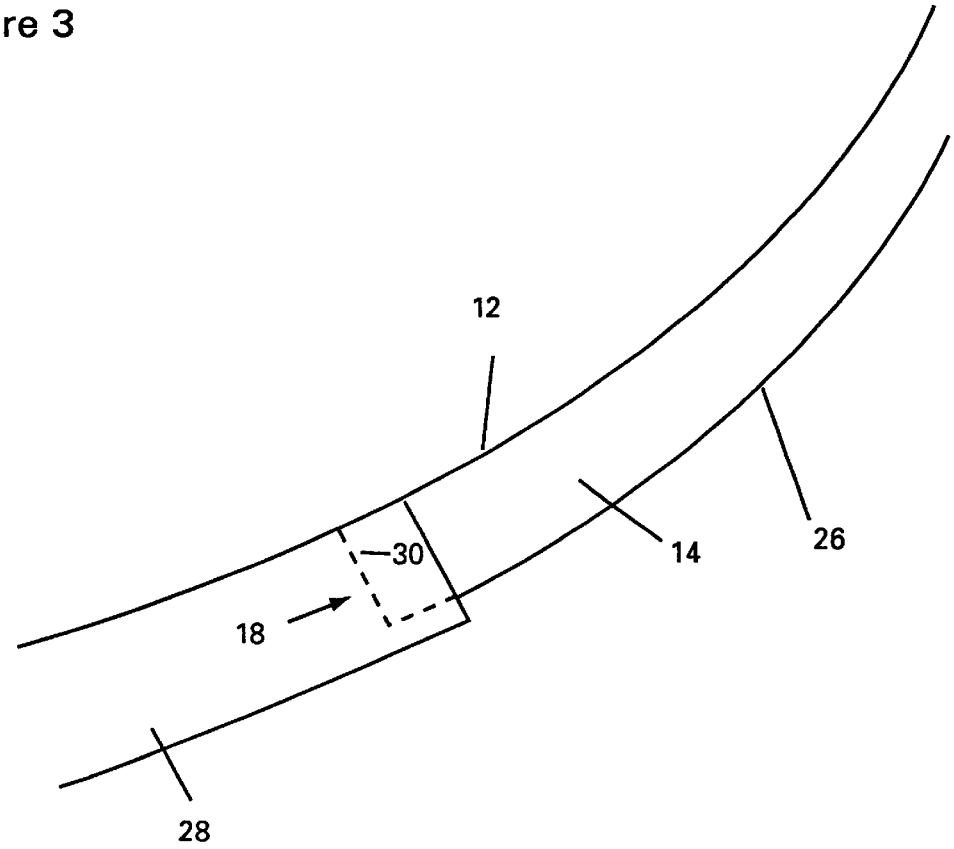
FIG. 3 is a side view illustrating a preferred embodiment of a fall of the present invention.

Referring to FIG. 3, a partial section of slide 10 is illustrated showing a fall 18 formed as previously described by the combination of flexible material 14 first section 26 of one width in combination with second section 28 of a greater width thereby creating a fall 18 at the end 30 of first section 26.

Figure 4:
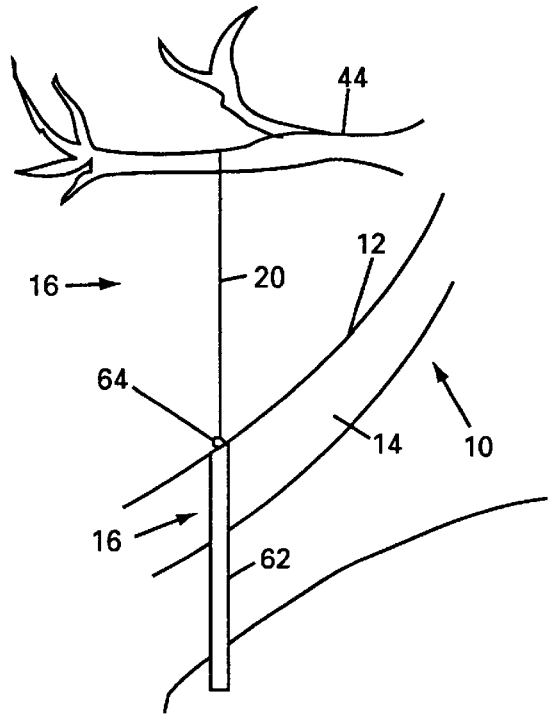
FIG. 4 is a side view illustrating a preferred embodiment of a lift of the present invention.

Referring now to FIG. 4, a partial section of slide 10 is shown illustrating lift 16 created by means of direction change cable 20. Again, in a preferred embodiment, direction change cable 20 is connected to an essentially immovable support 44 such as a tree limb of some substantial size. In the instance where a tree limb is not available, a post(s) 62 can be sunk next to one or both sides of slide 10 and suspension cables 12 then connected to post(s) 62 at connection point 64 as illustrated in FIG. 4. In either case, a lift 16 is provided because normally flexible material 14, suspended from suspension cables 12, deflects with the addition of weight to slide 10. However, at point 64, suspension cables 12 are prevented from deflecting, thereby creating a lift 16 at point 64 of slide 10. A user enters high end 22 of slide 10, slides down the slide and is lifted upward at point 64 due to the failure of flexible material 14 and cables 12 to give or deflect at that point.

Figure 5:
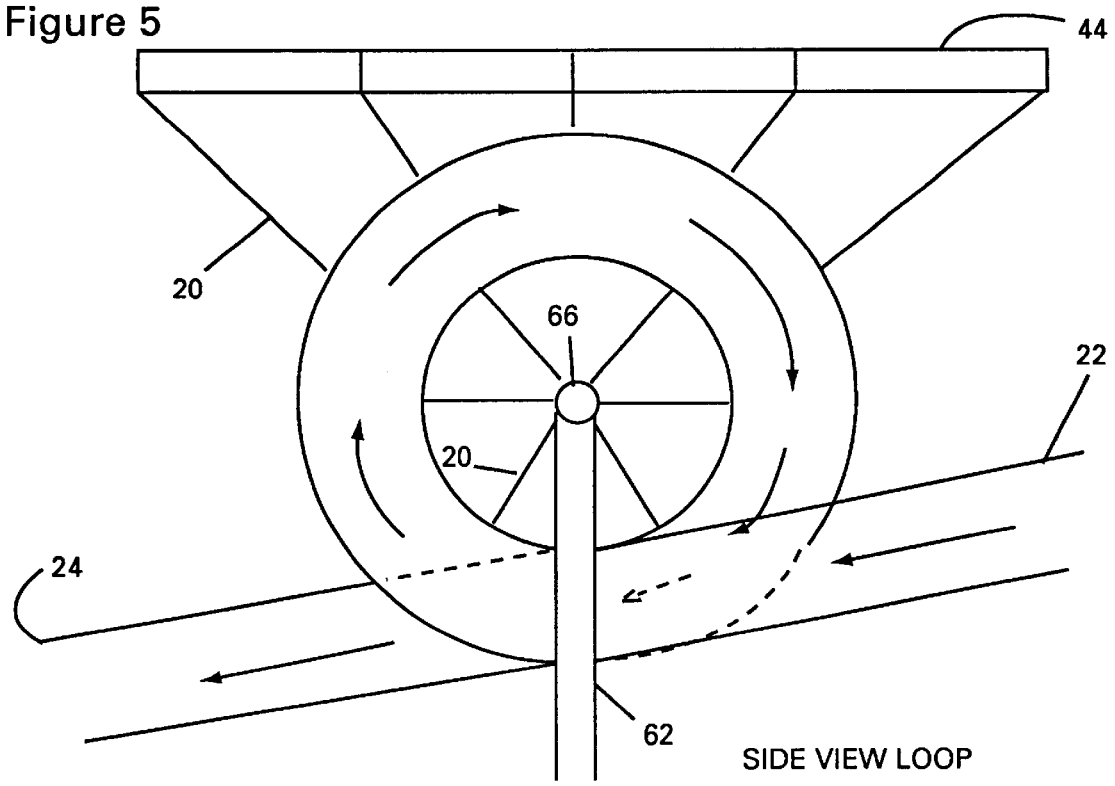
FIG. 5 is a side view of a preferred embodiment of a loop of the present invention.

Referring now to FIG. 5, a side view of a preferred embodiment of a loop of the present invention is provided. Post 62 is utilized to support slide 10 in the following manner. Post 62 has a transverse member 66 around (seen end on) which flexible material 14 loops. Direction change cables 20 are secured to transverse member 66 on the inside of the loop and direction change cables 20 are connected to the suspension cables 12 of slide 10 on the outside of the loop as illustrated. Direction change cables 20 on the outside of the loop are also connected to substantially non-moving support 44 which, again, could be a tree limb of sufficient size or an artificial post 62. A user enters the loop from high end 22 and slides in the direction of the direction arrows shown in FIG. 5, loops around transverse member 66 and continues in the direction of low end 24 after exiting the loop. While FIG. 5 illustrates the loop of the present invention in side view, it is obvious that the loop could also be horizontal, i.e. the same construction would be utilized as illustrated if the view were from the top so that an individual would enter slide 10 on high end 22 and rotate around transverse member 66 horizontally, as opposed to vertically.

Figure 6:
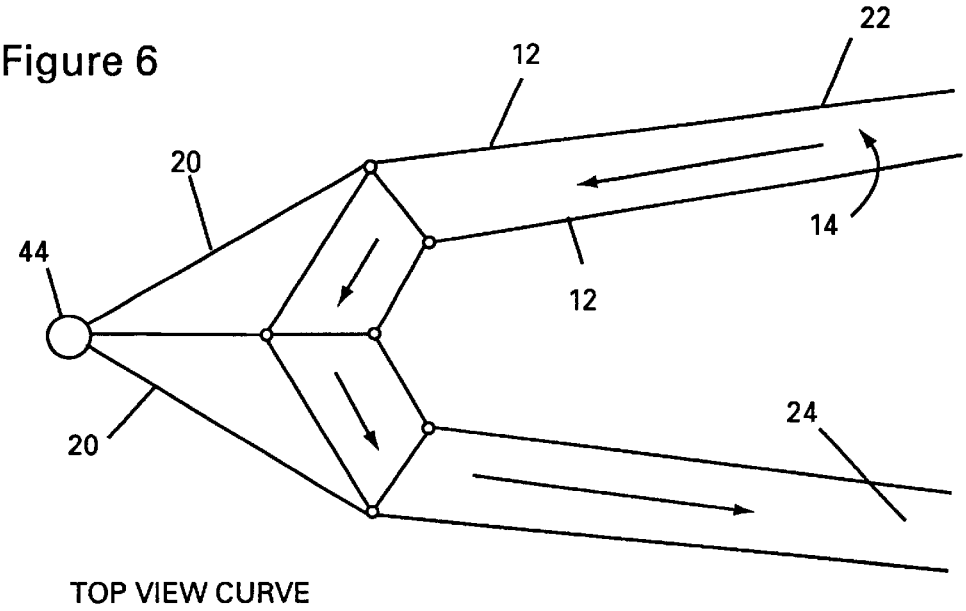
FIG. 6 is a top view illustrating a preferred embodiment of a curve of the present invention.

Referring now to FIG. 6, a top view of a curve in slide 10 is illustrated. In FIG. 6, substantially non-moving support 44 is positioned on the side away from the curve. Direction change cables 20 are connected to suspension cables 12 in a non-moving fashion so that flexible material 14 forms a C-shaped curve as illustrated in FIG. 6. Again, a user enters slide 10 at the high end 22 and curves in the direction of the direction arrows shown in FIG. 6 around the curve towards low end 24.

Figure 7:
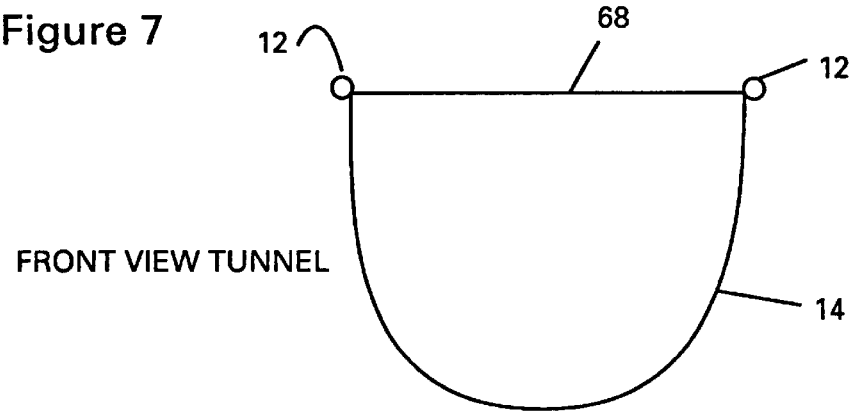
FIG. 7 is a front view of a preferred embodiment of a tunnel of the present invention.

Referring now to FIG. 7, a front view of a tunnel of the present invention is illustrated. In this illustration, flexible material 14 is covered by some cover 68 that is connected side to side to suspension cables 12. As a result, wherever cover 68 is placed on slide 10 a "tunnel" is created. Some or all of slide 10 could be covered by cover 68 or, as desired, a user could have portions of slide 10 covered and other portions uncovered.

Figure 8:
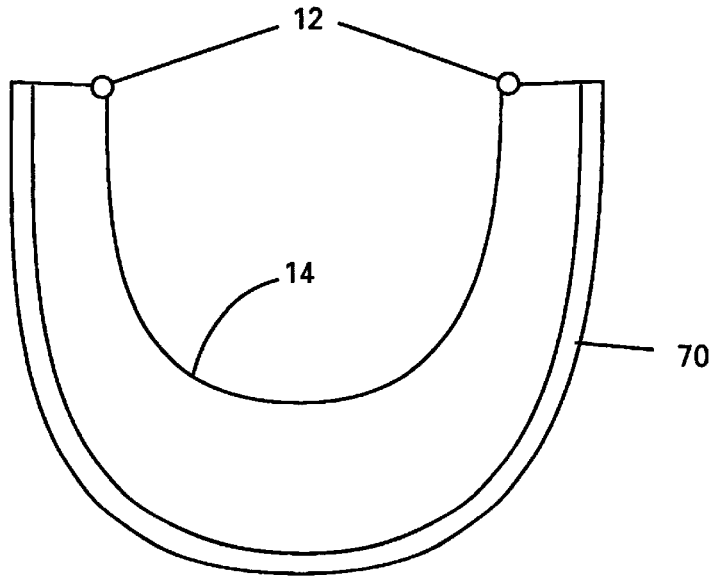
FIG. 8 is a front view of preferred embodiment of spreaders located beneath the slide of the present invention.

Referring now to FIG. 8, free hanging spreader bars 70 are illustrated. Free hanging spreader bars are connected to suspension cables 12 and hang beneath flexible material 14. Free hanging spreader bars 70 are formed of any substantially non-deformable material, such as steel or the like that provides rigidity to the spacing of suspension cables 12. That is, free hanging spreader bars 70 hold flexible material 14 and suspension cables 12 against collapse. That is, again, when a user slides down the slide, the weight of the person causes the cables 12 to draw toward each other. Free hanging spreader bars 70 prevent the flexible material 14 and the suspension cables 12 from collapsing together at the point where the user's weight impacts slide 10. Any number of free hanging spreader bars 70 that is appropriate for the particular design may be used.

Figure 9:
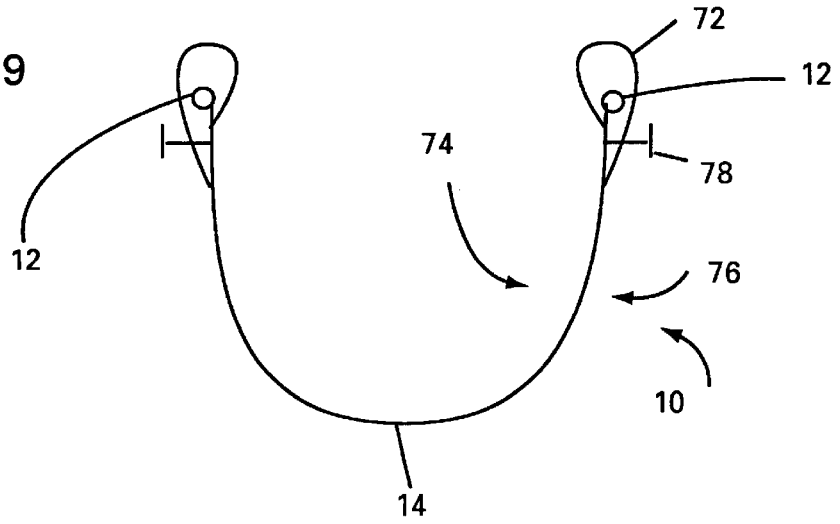
FIG. 9 is a front view of protective cable flaps of the present invention.

Referring now to FIG. 9, cable protective flaps 72 are illustrated. In a preferred embodiment, cable protective flap 72 is formed by means of sewing a section of flexible material 14 along the length of the upper edge of slide 10 where flexible material 14 is connected to suspension cables 12. The sewn connection is made on the inside 74 of flexible material 14. The cable protective flap 72 is then wrapped around suspension cables 12 to the outside 76 of flexible material 14 and held in place by securing tab 78. Securing tab 78 may be snaps, buckles, loops, hook and loop material, or any convenient securing device now known or hereafter developed. As a result of cable protective flap 72, however, a user is protected from even accidental contact with the suspension cables 12 when using slide 10.

The operation of slide 10, as previously described, should be obvious to one of ordinary skill in the art. Nonetheless, the important advantage of slide 10 is that it is easy to construct in any wilderness situation. Applicant's slide 10 is, in particular, useful in camps which may not be full time camps. That is, slide 10 can be set up and taken down as needed. In situations where the water elevation changes, slide 10 can be moved to accommodate the water level change. Likewise, if supports for suspension cables 12 are damaged or destroyed, new locations and connections for suspension cables 12 are typically readily available. If not, a few artificial posts 62 are all that are necessary for the creation of slide 10.

In a further preferred embodiment of the present invention, slide 10 is utilized not only as a slide into water 38, but also as a "water" slide. In this case, water, from a garden hose or any other available source, is introduced at the high end 22 of slide 10. The water reduces the friction of the user with the flexible material 14 and enhances the speed of slide 10.

Flexible material 14 can be made of any material now known or hereafter developed. Flexible material 14 may be made of any known plastic, such as polyvinyl chloride in some formation. It may also be that flexible material 14 may be made of material that is sufficiently slippery so that no water is needed. Additionally, it should be obvious that slide 10 can be utilized in situations where the user exits slide 10, not into water, but into some soft receiving area such as sand, wood chips or the like. As a result, slide 10 is useful not only in wilderness situations, but in neighborhood parks and homes. Importantly, slide 10 provides not only a slide but an amusement variety slide. Applicant's slide 10 includes at least one lift and one fall in every slide, thereby providing amusement park excitement inexpensively and efficiently.

While the present invention has been disclosed in connection with the preferred embodiments thereof, it should be understood that there may be other embodiments which fall within the spirit and scope of the invention as defined by the following claims.

What is claimed is:

1. A slide apparatus wherein a user slides in a downward direction, the slide comprising:

(a) at least a pair of suspension cables;

(b) a flexible material connected to said suspension cables; and (c) at least one lift means for temporarily changing a user's direction from down to up and at least one fall.

2. The apparatus of claim 1 wherein said flexible material further comprises:

(a) a high first end and a low second end; and (b) wherein at least one fall is located at the low second end and at least one fall is located between said high first end and said low second end.

3. The apparatus of claim 1 wherein said at least one fall further comprises:

(a) a first section of flexible material of one width connected to said suspension cables; and (b) a second section of flexible material of a second greater width independently connected to said suspension cables so as to hang beneath the first section of said flexible material at a low end of the first section of said flexible material.

4. The apparatus of claim 1 wherein said at least one lift means further comprises at least one direction change cable connected to said suspension cables at one end and to an immovable support at the other end, thereby restraining said flexible material and suspension cables against deflection at the direction change cable connection point with the suspension cables.

5. The apparatus of claim 1 further comprising a cover on said flexible material, connected to said suspension cables so as to form a tunnel over at least some of said flexible material.

6. The apparatus of claim 1 further comprising:

(a) a plurality of direction change cables connected to said suspension cables; and (b) said suspension cables and said flexible material conformed into the shape of a loop and held in position by said direction change cables.

7. The apparatus of claim 1 further comprising:

(a) a plurality of direction change cables connected to said suspension cables; and (b) said suspension cables and said flexible material conformed into the shape of a curve and held in position by said direction change cables.

8. The apparatus of claim 1 further comprising a plurality of spreader bars beneath said flexible material connected to said suspension cables.

9. The apparatus of claim 1 wherein said lift means further comprises a wedge shaped insert with a narrow edge of the wedge facing a high end of the slide, said wedge shaped insert attached underneath a first section of flexible material and on top of a second section of flexible material so that a lift is created thereby.

10. In a water slide with a high end and a low end wherein a user slides in a downward direction with water introduced at the high end, a cabled tarp water slide apparatus comprising:

(a) a pair of oppositely positioned cables;

(b) a tarp hung between said cables; and (c) at least one lift means for temporarily changing a user's direction from down to up.

11. The apparatus of claim 10 further comprising more than one fall.

12. The apparatus of claim 11 wherein said more than one fall further comprises a fall at the low end of said tarp with at least one intermediate fall between the high end and the low end of said tarp.

13. The apparatus of claim 11 wherein said more than one fall further comprises:

(a) a fall at the low end of said tarp; and (b) at least one intermediate fall between the high end of said tarp and the low end of said tarp wherein said at least one intermediate fall further comprises a section of tarp of one width connected to said pair of oppositely positioned cables and an independent second section of tarp of a greater width connected to said pair of oppositely positioned cables and beneath said first section of tarp.

14. The apparatus of claim 10 further comprising at least one tunnel.

15. The apparatus of claim 10 further comprising at least one loop.

16. The apparatus of claim 10 further comprising at least one curve.

17. The apparatus of claim 10 wherein said at least one lift means further comprises at least one direction change cable connected to said pair of oppositely positioned cables at a lift point for holding said pair of oppositely positioned cables from deflection in response to a weight passing over said lift point.

18. The apparatus of claim 10 further comprising cable protective flaps.

19. A water slide method comprising the steps of:

(a) connecting a pair of oppositely positioned cables to cable supports at a high end of a water slide and to cable supports at a low end of said water slide;

(b) connecting a tarp on and between said of pair of oppositely positioned cables;

(c) providing at least one lift and one fall in said tarp; and (d) adding water to said tarp at said high end.

20. The method of claim 19 further comprising the step of adding at least one slide feature from a group of features including tunnels, loops and curves.

* * * * *